US008073611B2

(12) United States Patent
Loeffler et al.

(10) Patent No.: US 8,073,611 B2
(45) Date of Patent: Dec. 6, 2011

(54) METHOD FOR CONTROLLING A COMPRESSION-IGNITION INTERNAL COMBUSTION ENGINE AND CONTROL DEVICE FOR CONTROLLING A COMPRESSION-IGNITION INTERNAL COMBUSTION ENGINE

(75) Inventors: Axel Loeffler, Backnang (DE); Wolfgang Fischer, Gerlingen (DE); Roland Karrelmeyer, Bietigheim-Bissingen (DE); Gerald Graf, Gaertringen (DE)

(73) Assignee: Robert Bosch GmbH, Stuttgart (DE)

( * ) Notice: Subject to any disclaimer, the term of this patent is extended or adjusted under 35 U.S.C. 154(b) by 280 days.

(21) Appl. No.: 12/328,164

(22) Filed: Dec. 4, 2008

(65) Prior Publication Data

US 2009/0187325 A1 Jul. 23, 2009

(30) Foreign Application Priority Data

Jan. 22, 2008 (DE) ..... 10 2008 005 524

(51) Int. Cl.
*F02D 41/26* (2006.01)

(52) U.S. Cl. ..... 701/102

(58) Field of Classification Search ..... 701/102–106, 701/115, 110–111, 113; 123/435
See application file for complete search history.

(56) References Cited

U.S. PATENT DOCUMENTS 7,761,219 B2 * 7/2010 Loeffler et al. ..... 701/103
* cited by examiner

*Primary Examiner* — Hai Huynh
(74) *Attorney, Agent, or Firm* — Kenyon & Kenyon LLP

(57) ABSTRACT

A method is described for controlling a compression-ignition internal combustion engine, including predefining a setpoint combustion point for a compression-ignition internal combustion engine, predefining a calculation model for calculating a probable deviation of a future cycle of the engine from the predefined setpoint combustion point while taking an ascertained actual combustion point of a completed cycle engine into consideration, predefining a mean deviation for the engine, operating the engine for a first cycle and ascertaining an actual combustion point of the first cycle, calculating a probable deviation of a second cycle, which occurs after the first cycle, of the engine from the predefined setpoint combustion point, comparing the calculated probable deviation of the second cycle to the predefined mean deviation, and ascertaining at least one operating variable for operating the engine at least during the second cycle as a function of the comparison. Also described is a related method.

10 Claims, 3 Drawing Sheets

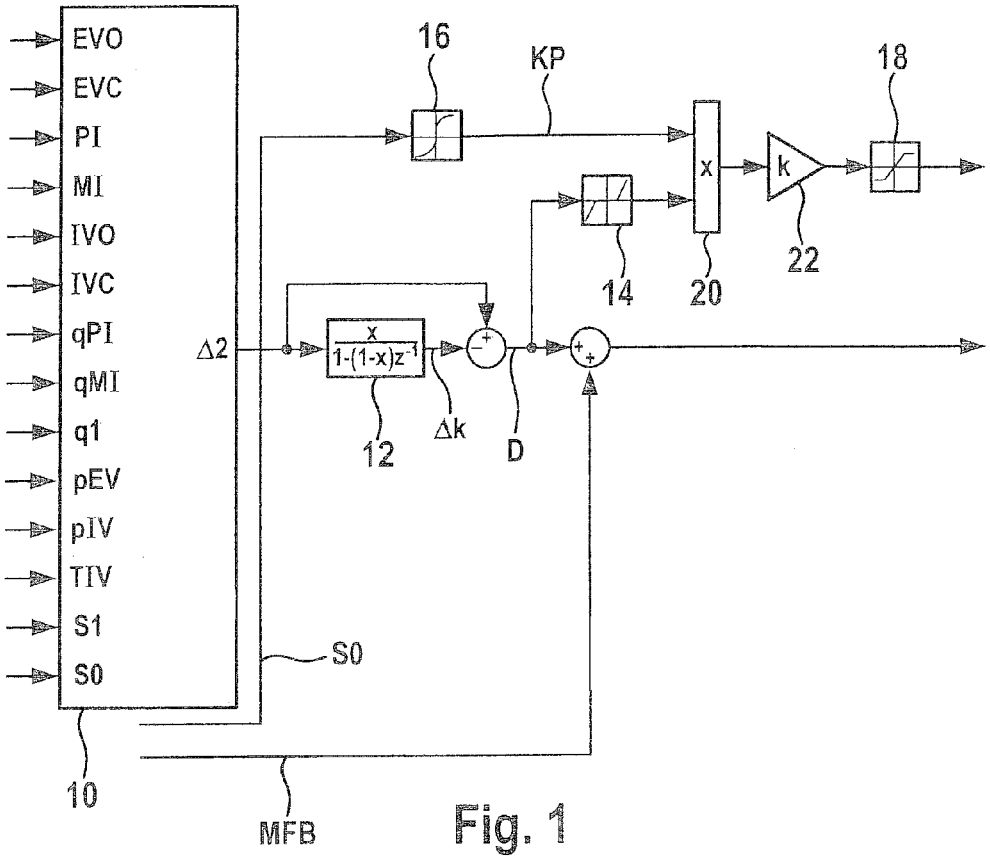
Fig. 1
Fig. 2
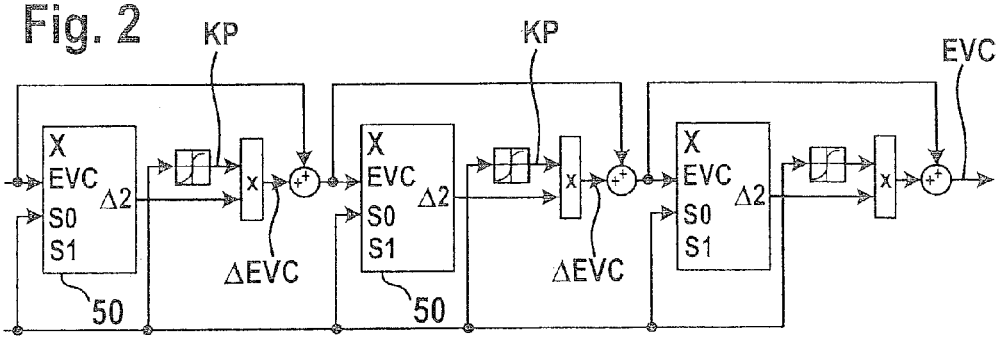

METHOD FOR CONTROLLING A COMPRESSION-IGNITION INTERNAL COMBUSTION ENGINE AND CONTROL DEVICE FOR CONTROLLING A COMPRESSION-IGNITION INTERNAL COMBUSTION ENGINE

FIELD OF INVENTION

The present invention relates to a method for controlling a compression-ignition internal combustion engine. Furthermore, the present invention relates to a corresponding control device for controlling a compression-ignition internal combustion engine.

BACKGROUND INFORMATION

In an Otto-engine combustion method, which is frequently referred to in the literature as a gasoline HCCI method (homogeneous charge compression ignition) or as a CAI method (controlled auto ignition), a fuel injected into an internal combustion engine is combusted without external ignition. The fuel is instead automatically ignited by mixture of the injected fuel with a hot exhaust gas and subsequent compression of the fuel-gas mixture.

CAI engines are typically equipped with a variable valve drive and a gasoline direct injection. One differentiates between a fully-variable valve drive, implemented by an electrohydraulic valve controller, for example, and a partially-variable valve drive, e.g., a valve drive controlled using the camshaft having two-point stroke and phase adjuster. The latter represents the more cost-effective alternative.

Because the hot residual gas in the internal combustion engine is responsible for initiating the combustion during the compression phase in a CAI operation, it is desirable to have a relatively large quantity of residual gas before the combustion in the cylinder. For example, an internal exhaust gas quantity may be kept in the cylinder because of negative valve overlaps. Additionally or alternatively thereto, an external exhaust gas quantity may be returned or sucked back in by briefly opening the outlet valve during the intake phase.

In addition to the exhaust gas quantity, the exhaust gas temperature is also significant for the ignition of the fuel injected into the internal combustion engine. Because the exhaust gas temperature is a function of the point in time of the preceding combustion, there is a relationship between a combustion point of a first cycle and the combustion point of the following second cycle. For example, an excessively late ignition of the fuel in the first cycle may trigger a premature ignition during the second cycle. A premature ignition during the first cycle correspondingly frequently causes a delay or a miss in the ignition of the fuel during the second cycle.

It is therefore desirable to have a possibility for preventing irregularities in the ignition of a fuel injected into a compression-ignition internal combustion engine.

SUMMARY OF THE INVENTION

The present invention provides a method for controlling a compression-ignition internal combustion engine and a control device for controlling a compression-ignition internal combustion engine.

The present invention is based on the finding that it is possible to predefine a calculation model, using which a probable deviation of a future cycle of a compression-ignition internal combustion engine from a predefined setpoint combustion point may be calculated while taking an ascertained actual combustion point of a completed cycle into consideration. An object of the present invention is, after completion of a first cycle which has occurred, to calculate a probable deviation for the second cycle, which has not yet occurred, from the predefined setpoint combustion point using the calculation model. Features which describe the actual combustion process of the first cycle are preferably used for this purpose.

The combustion point is to be understood as a variable which indicates a point in time of a combustion event during the combustion of the fuel injected into the compression-ignition internal combustion engine or a combustion status at a fixed point in time. For example, the combustion point is an ignition point in time, a combustion end, a combustion duration, a temperature curve feature during a combustion phase, and/or a pressure curve feature during the combustion phase. Appropriate features are, for example, a maximum temperature, a minimum temperature, and/or a mean temperature. The combustion point may also be a point in time at which a specific percentage of the injected fuel has combusted. A corresponding point in time is, for example, 50% mass conversion point MFB50 (mass fraction burnt 50%). The combustion point may preferably be ascertained using a pressure sensor, a temperature sensor, a structure-borne noise sensor, an ion stream sensor, and/or a speed sensor. The combustion point may be specified as a crankshaft angle.

The setpoint combustion point preferably corresponds to an optimum combustion event, at which an optimum operation of the compression-ignition internal combustion engine is ensured. The setpoint combustion point may be permanently predefined by a manufacturer of the control device and/or the internal combustion engine. The setpoint combustion point may also be output by a data output unit as a function of a rotational speed and/or a load during travel of the associated vehicle. The setpoint combustion point is, for example, a setpoint ignition point in time, a setpoint pressure feature during a combustion phase, a setpoint temperature feature during the combustion phase, and/or a setpoint 50% mass conversion point, such as a setpoint MFB50. The first and/or second cycle may be understood as an individual combustion cycle or a predefined number of combustion cycles.

An object of the present invention is a predetermination (prediction) of a probable deviation of the combustion point of the future cycle, which has not yet occurred, from the setpoint combustion point. In particular the ignition of the fuel of the main injection quantity has not yet occurred during the predetermination. The predetermined probable deviation may also be referred to as deterministic deviations. It may be ascertained on the basis of the comparison of the probable deviation to the predefined mean deviation whether or not the future cycle negatively influences an optimum course of the CAI combustion method. For example, an averaged value of the probable deviations, which is determined over a longer period of time, is predefined as the mean deviation. If the predicted combustion course of the future cycle deviates significantly from the predefined mean deviation, at least one operating variable for operation of the internal combustion engine may be fixed in such a way that the at least one operating variable counteracts the calculated probable deviation.

The present invention is based on the additional finding that it is only desirable in such situations to react to a deviation of a predicted combustion execution from the desired combustion execution if this deviation results in a predictable interference with the compression-ignition combustion operation. Insignificant deviations, in contrast, are hardly to be reacted to, because unnecessary correction interventions may additionally interfere with a regulated operation of the compression-ignition internal combustion engine. Above all, large and suddenly occurring deviations are therefore preferably to be reacted to.

The present invention allows a predictive pilot control for a desired setpoint combustion point. For example, a correction of at least one operating variable may be executed using an iterative method. A downstream adaptation, which is frequently necessary in typical control methods for compression-ignition internal combustion engines, may therefore be dispensed with. Because the probable deviations are essentially predictable and preventable, negative consequences of the deviations, which otherwise frequently occur, may be effectively prevented.

The method and the control device presented here achieve the objects described above without having to use a computer-intensive iteration or an adaptation method, which is typically very slow. The execution of the present invention thus requires a lower computational complexity than an iterative inversion.

In a refinement, the method for controlling a compression-ignition internal combustion engine includes the following additional steps: predefining a calculation formula for ascertaining the mean deviation while taking the calculated probable deviation of at least one completed cycle into consideration; operating the internal combustion engine at least for a starting cycle occurring before the first cycle and ascertaining an actual combustion point of the starting cycle; calculating a probable deviation of at least the first cycle from the predefined setpoint combustion point under consideration of the ascertained actual combustion point of the starting cycle using the calculation model; and predefining the mean deviation by ascertaining the mean deviation while taking the calculated probable deviation of the first cycle into consideration using the calculation formula. Rapid and/or high probable deviations are compensated for in a targeted way in this method. The refinement thus ensures an advantageous response to a load jump. The mean deviation may be set to zero at the beginning of the method.

At least one starting value is preferably predefined for the at least one operating variable, the probable deviation of the second cycle from the setpoint combustion point being calculated while taking the ascertained actual combustion point of the first cycle and at least one starting value into consideration using the calculation model. The at least one operating variable may be an injector activation variable, an air supply activation variable (e.g., inlet valve and/or throttle valve), and/or an exhaust valve activation variable. For example, the at least one operating variable is an injection quantity of a pilot injection and/or a main injection, an injection point in time of the pilot injection and/or the main injection, an opening and/or closing time of an air intake valve, an opening and/or closing time of an exhaust valve, an internal exhaust gas quantity, and/or an external exhaust gas quantity. The correction based on the calculated probable deviation of the future cycle may be calculated for each of these operating variables, which may also be referred to as manipulated variables. A reliable calculation of the probable deviation of the future cycle is ensured by the consideration of the at least one operating variable.

Advantageously, if the calculated probable deviation of the second cycle lies within a predefined deviation range around the mean deviation, the internal combustion engine is operated for at least the second cycle while maintaining the at least one starting value. Also, if the calculated probable deviation of the second cycle lies outside the predefined deviation range around the mean deviation, at least one new value may be ascertained for the at least one operating variable, and the internal combustion engine may be operated for at least the second cycle while maintaining the at least one new value. This ensures a good compensation of the calculated probable deviation and prevents the amplification of statistical fluctuations of the combustion point because of the correction intervention.

In a further preferred refinement, the method includes the following additional steps: predefining a data model for updating the probable deviation of the future cycle under consideration of the calculated probable deviation of the future cycle and the at least one new value for the at least one operating variable of the future cycle, updating the probable deviation of the second cycle while taking the calculated probable deviation of the second cycle into consideration using the data model, comparing the updated probable deviation of the second cycle to the predefined mean deviation, and fixing the at least one operating variable for the second cycle as a function of the comparison of the updated probable deviation of the second cycle to the predefined mean deviation. These additional method steps may increase the precision of the probable deviation and improve the suitability of the at least one operating variable fixed for the second cycle. The additional method steps may be repeated a desired number of times. For example, the additional method steps are repeated until the probable deviation deviates less than a maximum difference from the mean deviation. This ensures efficient prevention of excessively early or late combustions in the compression-ignition combustion method.

A basic calculation model is advantageously predefined as the calculation model for calculating a cylinder-independent state variable of the future cycle while taking the ascertained actual combustion point of the completed cycle into consideration. In addition, at least one cylinder model is predefined for at least one cylinder of the internal combustion engine to calculate a cylinder-specific probable deviation of the future cycle while taking the cylinder-independent state variable of the future cycle into consideration. This significantly simplifies the computing steps to be executed. In addition, this ensures a two-stage method for the application of the calculation model, for example, a physical gray box model. Due to the two stages of the method, the application may be divided into a cylinder-independent partial step and a cylinder-individual partial step, which additionally reduces the calibration complexity. This allows an efficient implementation of the model in regard to the resources.

A two-stage calibration or data input of the calculation model is also thus possible. The free parameters of the calculation model may be determined on the basis of suitable measured data. In this way, the calculation model may be calibrated on the basis of few dynamic measurements on the CAI engine. Because only few combustion cycles have to be used for the measurements, this reduces the required measuring effort. The abnormal combustions particularly critical in later use may be covered by the use of dynamic measurements. This is an advantage in relation to quasi-steady-state measurements having variations of the manipulated variables.

In a further preferred specific embodiment, a calculation model for calculating the probable deviation of the future cycle while additionally taking a (further) engine state variable, an environmental parameter, and/or a fuel parameter into consideration is predefined as the calculation model. The engine state variable describes a state of the engine which is significant for the execution of the CAI method, for example, an engine temperature and/or an age of the engine. The environmental parameter is preferably an ambient temperature.

The fuel parameter may reflect a temperature, a fuel quality, and/or a chemical composition of the fuel. Because the variables listed here may impair the ignition of the fuel and/or the course of the subsequent combustion, a reliable calculation of the probable deviation of the future cycle is ensured by taking the variables into consideration. The method is thus capable of responding to problems which frequently result because of environmental boundary conditions, engine conditions, or fuel conditions.

The advantages described in the above paragraphs are also ensured with a corresponding control device.

In a preferred specific embodiment, the compression-ignition internal combustion engine is an Otto engine. The compression-ignition internal combustion engine implemented as an Otto engine is distinguished in relation to typical external ignition methods by a reduced fuel consumption, in particular within the partial-load range. In addition, the Otto engine allows very good homogeneous mixture formation, a plurality of exothermic centers in the combustion chamber, and a low combustion temperature with a CAI method. This results in a very uniform and rapidly occurring combustion having a reduced pollutant emission, in particular in comparison to the laminar operation, which also saves fuel. A comparatively costly exhaust post-treatment system (e.g., in regard to nitrogen oxides) may thus be dispensed with.

BRIEF DESCRIPTION OF THE DRAWINGS

FIG. 1 shows a block diagram illustrating a first embodiment of the method for controlling a compression-ignition internal combustion engine.

FIG. 2 shows a block diagram illustrating a second embodiment of the method for controlling a compression-ignition internal combustion engine.

DETAILED DESCRIPTION

Figure 3:
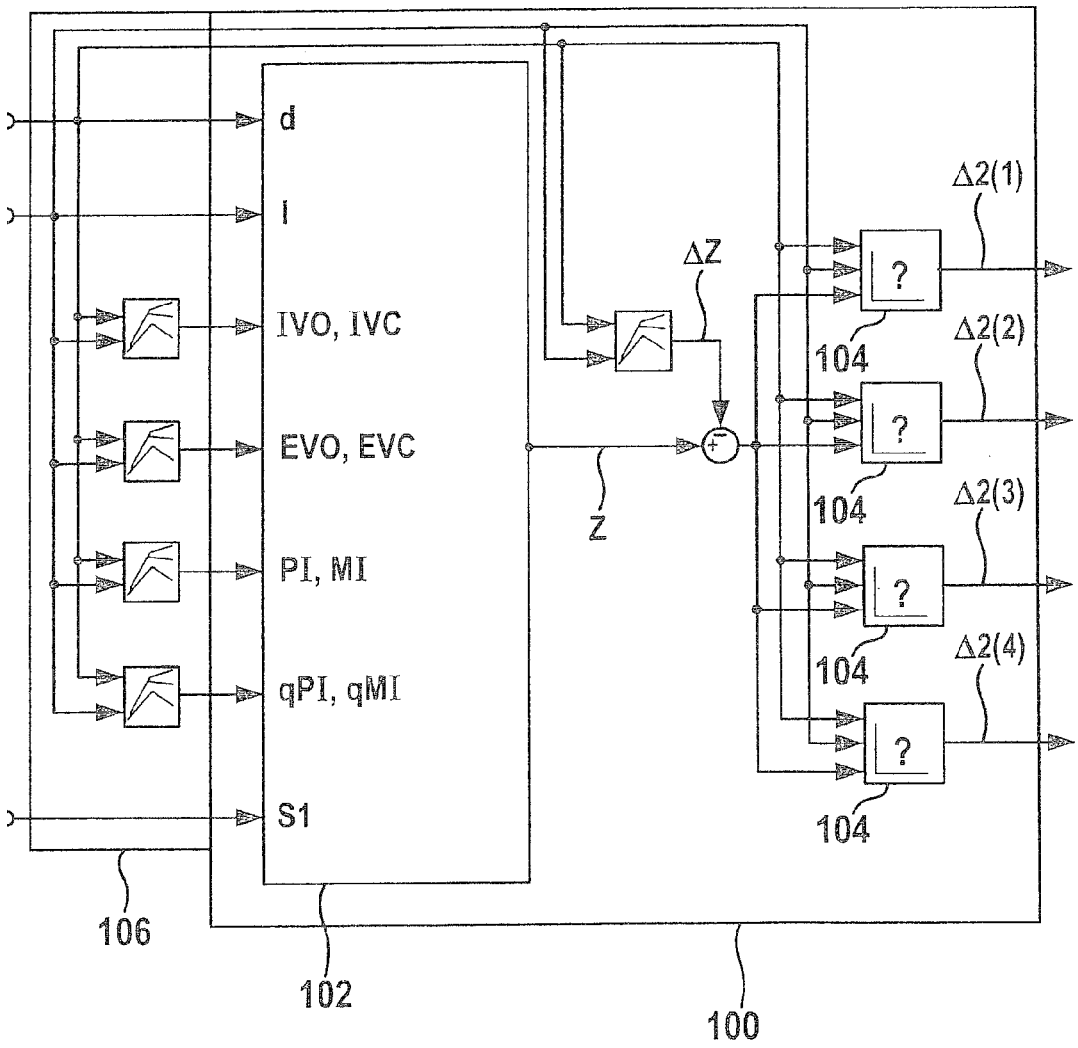
FIG. 3 shows a block diagram illustrating a third embodiment of the method for controlling a compression-ignition internal combustion engine.

FIG. 1 shows a block diagram illustrating a first embodiment of the method for controlling a compression-ignition internal combustion engine. The method is shown after at least one first cycle has occurred. The fuel ignition of the first cycle has already occurred before the beginning of the method.

In a first step of the method shown in FIG. 1, a setpoint combustion point S0 is provided to a computer unit 10. Setpoint combustion point S0 may be provided during travel while taking a current load and/or a current speed of the associated vehicle into consideration. Setpoint combustion point S0 is, for example, a setpoint ignition point in time, a setpoint feature during a combustion phase, a setpoint temperature feature during the combustion phase, and/or a setpoint 50% mass conversion point, such as a setpoint MFB50. The setpoint combustion point may be specified as a crankshaft angle.

An actual combustion point S1 of the first cycle, ascertained using a sensor (not shown), is also provided to computer unit 10. Actual combustion point S1 is, for example, an ignition point in time of the first cycle, a pressure feature during the first cycle (e.g., mean induced pressure from 70° before top dead center (TDC) to 70° after TDC), a temperature feature during the first cycle, and/or a 50% mass conversion point (MFB50) of the first cycle. Actual combustion point S1 may also relate to another percentage value. Actual combustion point S1 may be specified as a crankshaft angle. The sensor for ascertaining actual combustion point S1 includes, for example, a temperature sensor, a pressure sensor, a structure-borne noise sensor, an ion stream sensor, and/or a rotational speed sensor.

In addition to setpoint combustion point S0 and actual combustion point S1 of the first cycle, starting values are output to computer unit 10 for the operating variables for operating the internal combustion engine (not shown). The operating variables are an exhaust valve opening time EVO (exhaust valve open), an exhaust valve closing time EVC (exhaust valve closing), an air intake valve opening time IVO (intake valve open), an air intake valve closing time IVC (intake valve closing), a pilot injection point in time PI (pilot injection), a main injection point in time MI (main injection), a quotient of the pilot injection quantity to the total injection quantity qPI (possibly relative), and a quotient of the main injection quantity to the total injection quantity qMI (possibly relative). Other manipulated variables of the internal combustion engine, such as injection ratio q1 as a quotient of the pilot injection quantity and the main injection quantity, may also be output to computer unit 10 as an alternative or a supplement to operating variables EVO, EVC, IVO, IVC, PI, MI, qPI, and qMI listed here. In addition, parameters which describe the boundary conditions during the execution of the first cycle, such as a pressure pEV at the exhaust valve, a pressure pIV at the air intake valve, and a temperature TIV at the air intake valve, may be output to computer unit 10. Furthermore, fuel parameters, such as a fuel temperature and/or a fuel quality, an engine state variable, and/or ambient parameters, preferably an ambient temperature, may be provided to computer unit 10.

Computer unit 10 is designed to calculate a probable deviation Δ2 of the combustion point of a second cycle from predefined setpoint combustion point S0 on the basis of values S0, S1, EVO, EVC, IVO, IVC, PI, MI, qPI, qMI, pEV, pIV, and TIV output thereto. It is expressly noted here that at the point in time at which probable deviation Δ2 is calculated, the second cycle has not yet occurred. In particular, the ignition of the second cycle has not yet taken place. The second cycle has preferably not yet begun at the point in time of the calculation of probable deviation Δ2.

A calculation model for calculating probable deviation Δ2 is stored on a memory unit (not shown) of computer unit 10. Probable deviation Δ2 of the second cycle calculated by computer unit 10 may be used directly as an input variable of a P element to calculate a manipulated variable correction. It is expedient for the reinforcement of the P element to be determined as a function of the operating point and stored in a characteristics map.

Calculated probable deviation Δ2 is output to a low-pass filter 12. Low-pass filter 12 includes a memory unit (not shown), on which a previously calculated mean deviation Δ(k−1) is stored. Mean deviation Δ(k−1) is a mean value over multiple calculated probable deviations of the preceding cycles. Mean deviation Δ(k−1) thus represents the stored value or state value of low-pass filter 12.

Furthermore, a calculation formula is stored on low-pass filter 12, using which mean deviation Δ(k−1) may be calculated while taking the probable deviations of the preceding cycles into consideration. Low-pass filter 12 is additionally designed to calculate an updated value for mean deviation Δ(k) taking the probable deviation Δ2 of the second cycle into consideration. Equation (GL1) applies, for example:

$$\Delta(k)=(1-x)\cdot\Delta(k-1)+x\cdot\Delta 2, \quad \text{(GL1)}$$

x being a damping factor and k being the cycle number. Damping factor x is in a value range between 0 and 1. The updated value for mean deviation Δ(k) is subsequently stored on the low-pass filter.

In addition, mean deviation Δ(k)=Δk calculated by low-pass filter 12 is multiplied by the value (−1) and added to calculated probable deviation Δ2 of the second cycle. The result is a difference D (a high-pass filtered Δ2), which is defined, for example, by the equation (GL2):

$$D=\Delta 2-\Delta(k)=(1-x)[(\Delta 2-\Delta(k-1)] \quad \text{(GL2)}$$

In this way, quasi-constant corrections may be filtered out using low-pass filter 12. Calculated difference D may be added to a provided setpoint 50% mass conversion point MFB. An absolute estimation for the actual combustion point of the second cycle is thus obtained.

In addition, calculated difference D passes through a dead zone element 14. Dead zone element 14 is advantageously set in such a way that a correction of an operating variable EVO, EVC, IVO, IVC, PI, MI, qPI, and/or qMI only occurs if difference D exceeds a specific comparison value. For this purpose, dead zone element 14 compares difference D to the comparison value. If difference D is greater than the comparison value, it is provided at the output of dead zone element 14. Otherwise, a value is not provided at the output of dead zone element 14.

To compensate for difference D lying above the comparison value, a data output unit 16 outputs at least one gain factor KP, which reflects the dependence of a combustion feature on at least one operating variable. An example of a sensitivity KS of compression-ignition combustion as a function of exhaust valve closing time EVC is specified in equation (GL3).

$$KS=\frac{\Delta 2}{\Delta EVC} \quad \text{(GL3)}$$

ΔEVC is a correction for the exhaust valve closing time. Gain factor KP of the P element results according to equation (GL4):

$$KP=\frac{-1}{KS} \quad \text{(GL4)}$$

More precise deviation Δ2 is then multiplied in the P element by gain factor KP using a multiplication unit 20, to obtain a corresponding correction ΔEVC for the exhaust valve closing time.

To prevent a correction of one of operating variables EVO, EVC, IVO, IVC, PI, MI, qPI, or qMI from exceeding a predefined correction maximum limit, each calculated correction value is output to a saturation unit 18. Saturation unit 18 is designed to compare a correction value for an operating variable EVO, EVC, IVO, IVC, PI, MI, qPI, or qMI to the predefined correction maximum limit and, if the correction value exceeds the correction maximum limit, to fix the correction value at the correction maximum limit. The correction values checked in this way are subsequently output to the internal combustion engine. At least during the second cycle, the correction values are maintained by the control system of the internal combustion engine. At least one of the correction values may also be multiplied by a factor k, which is not a function of the operating point, using a further gain factor 22. This allows damping of the correction values (k<1) or an amplification of the correction values (k>1).

To calibrate data output unit 16, a dependence of the combustion point on at least one of operating variables EVO, EVC, IVO, IVC, PI, MI, qPI, and qMI is ascertained starting from a fixed operating point of the internal combustion engine. The corresponding measurement may either be performed on the internal combustion engine itself or on a model of the internal combustion engine. For example, the dependence of the combustion point on particular operating variable EVO, EVC, IVO, IVC, PI, MI, qPI, and qMI is ascertained by plotting noise signals on at least one of operating variables EVO, EVC, IVO, IVC, PI, MI, qPI, and qMI and subsequent correlation analysis.

It is particularly advantageous if the model-based pilot controller runs in parallel to a feedback regulator which is set to be slower. This may be performed via a logic which assumes the correction of the model-based pilot controller only upon special events, such as load jumps or misfirings. In this way, the two control and regulating units may be prevented from working against one another.

FIG. 2 shows a block diagram illustrating a second embodiment of the method for controlling a compression-ignition internal combustion engine.

The second embodiment relates to a cascading method for a data-driven model. The model preferably includes kernel-based, statistical learning methods (Gaussian processes or support vector machines) and/or neural networks. In the cascading method, an update of probable deviation Δ2 and the calculation of correction ΔEVC for the exhaust valve closing time are executed multiple times one after another, particular calculated correction ΔEVC for the exhaust valve closing time being taken into consideration to update probable deviation Δ2. For the sake of better clarity, the subtraction of the low-pass filtered probable deviation and the dead center element described above are not shown.

In a first step of the method, a data model 50, whose function is described in greater detail below, is provided. Data model 50 is stored, for example, on a computer unit 10 (not shown).

An output value for exhaust valve closing time EVC is output to data model 50. Above-mentioned actual combustion point S1 of the first cycle, which has already occurred, and setpoint combustion point S0 are also related to data model 50. Furthermore, other operating variables, fuel parameters, and/or ambient parameters which influence an execution of a combustion in the compression-ignition internal combustion engine may also be provided to data model 50. As an example of these variables, variable X is output to data model 50.

Data model 50 is designed to calculate a new value for probable deviation Δ2 of the second cycle from setpoint combustion point S0 on the basis of provided values X, EVC, S0, and S1. Probable deviation Δ2 of the second cycle calculated by data model 50, which has not yet occurred, is subsequently multiplied with sensitivity KS as described above. The result of this multiplication is a correction ΔEVC for the exhaust valve closing time.

Newly determined correction ΔEVC for the exhaust valve closing time is then added to exhaust valve closing time EVC and output again together with above-mentioned variables X, S0, S1 to data model 50. Data model 50 recalculates probable deviation Δ2 of the second cycle, which has not yet occurred, while taking values X, S0, S1, and EVC into consideration. This may be referred to as the update of probable deviation Δ2 while taking correction ΔEVC for the exhaust valve closing time into consideration. The above-mentioned method steps may be subsequently repeated multiple times.

An exhaust valve closing time EVC which is optimally adapted to the operational and environmental conditions is ascertained by the multiple repetitions of the cited method steps. Ascertained exhaust valve closing time EVC is optimized in regard to a lowest possible probable deviation Δ2 of the second cycle from setpoint combustion point S0.

Exhaust valve closing time EVC ascertained in this way is subsequently output to the control system of the internal combustion engine. The control system controls the internal combustion engine in such a way that ascertained exhaust valve closing time EVC is maintained at least for the second cycle. Loud/knocking combustions or misfirings may thus be prevented during dynamic CAI operation.

The method explained on the basis of FIG. 2 relates to an optimization of exhaust valve closing time EVC. Of course, the method may also be used for optimizing another of above-mentioned operating variables EVO, IVO, IVC, PI, MI, qPI, and qMI. A cylinder-specific optimization of particular operating variable EVO, EVC, IVO, IVC, PI, MI, qPI, or qMI is also possible.

FIG. 3 shows a block diagram illustrating a third embodiment of the method for controlling a compression-ignition internal combustion engine.

Calculation model 100 explained on the basis of FIG. 3 includes a basic calculation model 102 for calculating a cylinder-independent state variable and multiple cylinder models 104, each for a cylinder of an associated internal combustion engine (not shown). Four cylinder models 104 for a compression-ignition internal combustion engine having four cylinders are shown as an example.

Calculation model 100 additionally also includes a unit for determining control parameter 106 as a function of the operating point. The unit for determining control parameter 106 as a function of the operating point is designed to ascertain a rotational speed d and a load l during travel of the associated vehicle. As an alternative thereto, rotational speed d and load l may also be output from a central vehicle control system via a vehicle bus to the unit for determining control parameter 106 as a function of the operating point. Pilot controller 106 then ascertains output values for operating variables EVO, EVC, IVO, IVC, PI, MI, qPI, or qMI which are suitable for rotational speed d and current load l. Operating variables IVO, IVC, EVP, EVC, PI, MI, qPI, and qMI determined by the unit for determining control parameter 106 as a function of the operating point are output together with rotational speed d and load 1 to basic calculation model 102. Furthermore, ascertained actual combustion point S1 of the first cycle, which has already occurred, is output to basic calculation model 102 by a sensor (not shown).

Basic calculation model 102 is designed to calculate a cylinder-independent state variable Z from input variables S0, S1, l, p, EVO, EVC, IVO, IVC, PI, MI, qPI, and/or qMI. For this purpose, basic calculation model 102 is calibrated cylinder-independent. It is ensured by this procedure that basic calculation model 102 must be worked through only once for each cycle for which a probable deviation is to be predicted in use. This makes working through basic calculation model 102 for each individual cylinder of the internal combustion engine unnecessary.

Basic calculation model 102 may thus contain more complex computing mechanisms, without the prediction of a probable deviation for a cycle which has not yet occurred being noticeably delayed. If calculation model 100 did not contain cylinder-independent basic calculation model 102, these complex computing mechanisms would have to be executed four times for an internal combustion engine having four cylinders for each cycle to predict the associated probable deviation, for example.

Cylinder-independent state variable Z, for example, a cylinder pressure, a temperature, and/or a gas mass at a specific crankshaft angle before start of the combustion, which is calculated by a basic calculation model 102, may optionally be adjusted using a correction value ΔZ as a function of rotational speed d and load l. However, this is not necessary. Subsequently, cylinder-independent state variable Z is output to cylinder models 104. Cylinder models 104 are designed to calculate a probable deviation Δ2(1) to Δ2(4) of the cylinder assigned specifically thereto from setpoint combustion point S0. For example, cylinder models 104 take the typical behavior of the cylinder assigned thereto into consideration, such as an energy exchange of the cylinder in the form of heat with an adjacent cylinder.

A series of dynamic measurements is preferably used to determine the cylinder-individual dependencies of particular probable deviations Δ2(1) through Δ2(4). In a first partial step, the corresponding curves of the pilot control values are supplied to the model as input variables and the state variables for each cycle thus resulting are stored. In a second partial step, the cylinder-independent state variables are correlated via characteristics curves as a function of the operating point to the cylinder-individual measured combustion states, for example, MFB50 values, for all cylinders. In a particularly advantageous variant, only the deviations of the calculated states from the neutral states are correlated with the cylinder-individual measured deviations of the combustion states from the particular setpoint combustion point.

Using the method described, cylinder-specific probable deviations Δ2(1) through Δ2(4) may be predicted for a second cycle which has not yet occurred using a comparatively low operating effort. Cylinder-specific probable deviations Δ2(1) through Δ2(4) may subsequently be analyzed to re-ascertain cylinder-specific operating variables in such a way that predicted probable deviations Δ2(1) through Δ2(4) may be reduced or prevented. A known cylinder-specific probable deviation Δ2(1) through Δ2(4) may be counteracted in this way.

The method described in the above sections may be used particularly advantageously for an Otto engine having the CAI mode of operation. The Otto engine preferably has a partially-variable valve operation and a gasoline direct injection.

Figure 4:
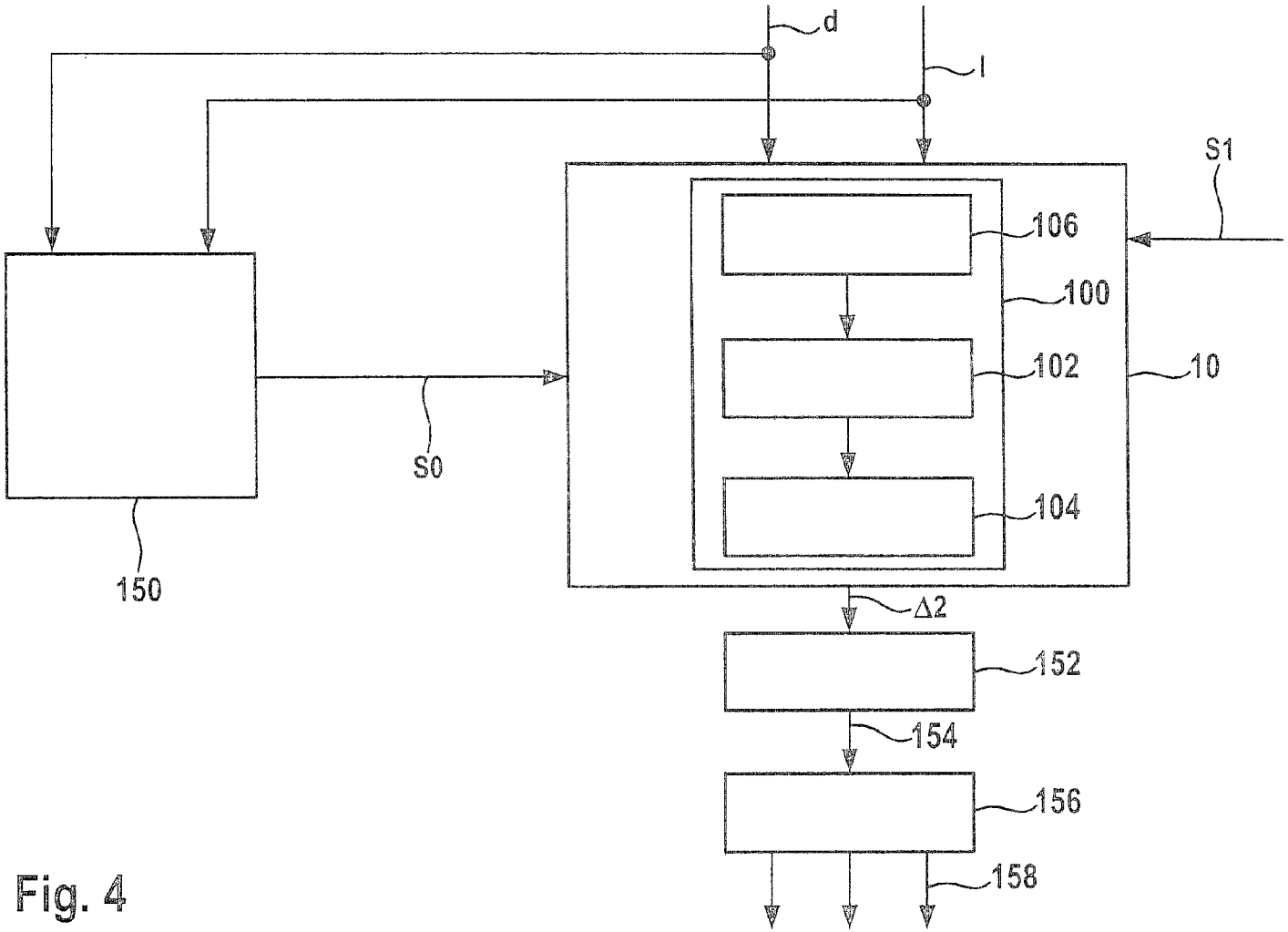
FIG. 4 shows a schematic illustration of an embodiment of the control device for controlling a compression-ignition internal combustion engine.

FIG. 4 shows a schematic illustration of an embodiment of the control device for controlling a compression-ignition internal combustion engine.

The control device includes a data output unit 150, which is designed to ascertain an instantaneous rotational speed d and an existing load l of a vehicle equipped with the control device during travel. Data output unit 150 ascertains a setpoint combustion point S0 for a compression-ignition internal combustion engine (not shown) of the vehicle as a function of rotational speed d and load l. Setpoint combustion point S0 established by a data output unit 150 is particularly suitable for the current values of speed d and load l.

Setpoint combustion point S0 ascertained by data output unit 150 is subsequently output to a computer unit 10. A calculation model 100 is stored on computer unit 10. Calculation model 100 includes, as already explained on the basis of FIG. 3, a unit for determining control parameter 106 as a function of the operating point, a basic calculation model 102, and multiple cylinder models 104. For the sake of clarity, however, only one of cylinder models 104 is shown in FIG. 4.

Models 102 through 106 are designed to execute the computing operations described above.

Computer unit 10 additionally also has an input for receiving an actual combustion point S1 of a first cycle of the internal combustion engine ascertained by a sensor. The sensor may possibly be a component of the control device. Actual combustion point S1 may also be measured by an internal vehicle sensor, which is not a component of the control device.

As already explained previously, computer unit 10 is designed to calculate a probable deviation of a second cycle, which has not yet occurred, as a function of received actual combustion point S1 of the first cycle. Calculated probable deviation Δ2 is subsequently output to a comparison unit 152 of the control device. Comparison unit 152 is designed to compare calculated probable deviation Δ2 of the second cycle to a provided mean deviation. In this way, comparison unit 152 is capable of responding in a targeted way to rapid and large deviations Δ2.

Comparison unit 152 subsequently outputs a comparison signal 154 corresponding to the comparison of probable deviation Δ2 of the second cycle to the provided mean deviation to an analysis unit 156. Analysis unit 156 then ascertains, as a function of comparison signal 154, at least one operating variable for operating the internal combustion engine in such a way that calculated probable deviation Δ2 may be counteracted. A control signal 158 corresponding to the at least one operating variable is subsequently output by analysis unit 156 to the control system (not shown) of the compression-ignition internal combustion engine. This ensures reliable maintenance of predefined setpoint combustion point S0 during an compression-ignition combustion operation.

What is claimed is:

1. A method for controlling a compression-ignition internal combustion engine, the method comprising:

predefining a setpoint combustion point for the compression-ignition internal combustion engine;

predefining a calculation model for calculating a probable deviation of a future cycle of the internal combustion engine from the predefined setpoint combustion point while taking an ascertained actual combustion point of a completed cycle of the internal combustion engine into consideration;

predefining a mean deviation for the internal combustion engine;

operating the internal combustion engine for a first cycle and ascertaining an actual combustion point of the first cycle;

calculating a probable deviation of a second cycle, which occurs after the first cycle, of the internal combustion engine from the predefined setpoint combustion point, taking into consideration the ascertained actual combustion point of the first cycle using the calculation model;

comparing the calculated probable deviation of the second cycle to the predefined mean deviation; and ascertaining at least one operating variable for operating the internal combustion engine at least during the second cycle as a function of the comparison of the calculated probable deviation of the second cycle to the predefined mean deviation.

2. The method according to claim 1, further comprising:

predefining a calculation formula for ascertaining the mean deviation while taking the calculated probable deviation of at least one completed cycle into consideration;

operating the internal combustion engine at least for a starting cycle occurring before the first cycle and ascertaining an actual combustion point of the starting cycle;

calculating a probable deviation of at least the first cycle from the predefined setpoint combustion point under consideration of the ascertained actual combustion point of the starting cycle using the calculation model; and predefining the mean deviation by ascertaining the mean deviation while taking the calculated probable deviation of the first cycle into consideration using the calculation formula.

3. The method according to claim 1, further comprising:

predefining at least one starting value for the at least one operating variable; and calculating the probable deviation of the second cycle from the setpoint combustion point while taking the ascertained actual combustion point of the first cycle and the at least one starting value into consideration using the calculation model.

4. The method according to claim 3, further comprising:

operating the internal combustion engine, if the calculated probable deviation of the second cycle lies within a predefined deviation range around the mean deviation, for at least the second cycle while maintaining the at least one starting value.

5. The method according to claim 3, further comprising:

ascertaining, if the calculated probable deviation of the second cycle lies outside the predefined deviation range around the mean deviation, at least one new value for the at least one operating variable; and operating the internal combustion engine for at least the second cycle while maintaining the at least one new value.

6. The method according to claim 5, further comprising:

predefining a data model for updating the probable deviation of the future cycle under consideration of the calculated probable deviation of the future cycle and the at least one new value for the at least one operating variable of the future cycle;

updating the probable deviation of the second cycle while taking the calculated probable deviation of the second cycle into consideration using the data model;

comparing the updated probable deviation of the second cycle to the predefined mean deviation; and fixing the at least one operating variable for the second cycle as a function of the comparison of the updated probable deviation of the second cycle to the predefined mean deviation.

7. The method according to claim 1, further comprising:

predefining a basic calculation model, for calculating a cylinder-independent state variable of the future cycle while taking the ascertained actual combustion point of the completed cycle into consideration, as the calculation model; and predefining at least one cylinder model for at least one cylinder of the internal combustion engine to calculate a cylinder-specific probable deviation of the future cycle while taking the cylinder-independent state variable of the future cycle into consideration.

8. The method according to claim 1, further comprising:

predefining a calculation model, for calculating the probable deviation of the future cycle, while additionally taking at least one of an engine state variable, an ambient parameter, and a fuel parameter into consideration, as a calculation model.

9. A control device for controlling a compression-ignition internal combustion engine comprising:

a data output unit configured to provide a setpoint combustion point for the compression-ignition internal combustion engine;

a computer unit having an input for receiving an actual combustion point, ascertained by a sensor, of a first cycle of the internal combustion engine and a memory unit, on which a calculation model, for calculating a probable deviation of a second cycle of the internal combustion engine, occurring after the first cycle, from the predefined setpoint combustion point while taking the received actual combustion point of the first cycle into consideration, is stored, the computer unit being configured to calculate the probable deviation of the second cycle while taking the received actual combustion point of the first cycle into consideration using the calculation model;

a comparison unit configured to compare the calculated probable deviation of the second cycle to a provided mean deviation; and an analysis unit configured to ascertain, as a function of the comparison of the calculated probable deviation of the second cycle to the predefined mean deviation, at least one operating variable for operating the internal combustion engine at least during the second cycle.

10. The control device according to claim 9, wherein the internal combustion engine is an Otto engine.

* * * * *